United States Patent [19]

Malley

[11] Patent Number: 4,654,091

[45] Date of Patent: Mar. 31, 1987

[54] ELIMINATION OF QUENCH CRACKING IN SUPERALLOY DISKS

[75] Inventor: David R. Malley, Manchester, Conn.

[73] Assignee: United Technologies Corporation, Hartford, Conn.

[21] Appl. No.: 417,760

[22] Filed: Sep. 13, 1982

Related U.S. Application Data

[63] Continuation of Ser. No. 215,201, Dec. 10, 1980, abandoned.

[51] Int. Cl.[4] ..... C22F 1/10

[52] U.S. Cl. ..... 148/13.1

[58] Field of Search ..... 148/13.1, 13; 428/678, 428/680

[56] References Cited

U.S. PATENT DOCUMENTS

| | | | |
|---|---|---|---|
| 1,859,623 | 5/1932 | Gregg | 148/149 |
| 1,934,741 | 11/1933 | Schulein | 148/7 |
| 1,953,445 | 4/1934 | Stevens | 148/7 |
| 2,295,777 | 9/1942 | Denneen et al. | 148/21 |
| 2,619,439 | 11/1952 | Rennick | 148/21.56 |
| 2,887,420 | 5/1959 | Llewelyn | 148/13.1 |
| 3,037,878 | 6/1962 | Cowles et al. | 117/6 |
| 3,250,650 | 5/1966 | Gray | 148/14 |
| 3,370,993 | 2/1968 | Carpenter et al. | 148/13.1 |
| 3,489,540 | 1/1970 | Cook | 428/678 |
| 3,558,367 | 1/1971 | Eck | 148/3 |
| 3,741,821 | 6/1973 | Athey et al. | 148/13.1 |
| 4,253,885 | 3/1981 | Maurer et al. | 148/13.1 |

*Primary Examiner*—R. Dean

*Attorney, Agent, or Firm*—Charles E. Sohl

[57] ABSTRACT

Quench cracking of nickel base superalloy articles is avoided by plating the articles with a layer of nickel or similar metal prior to heat treatment.

1 Claim, No Drawings

ELIMINATION OF QUENCH CRACKING IN SUPERALLOY DISKS

DESCRIPTION

This is a continuation of application Ser. No. 215,201 filed on Dec. 10, 1980, now abandoned.

TECHNICAL FIELD

This invention relates to the heat treatment of massive superalloy articles, particularly gas turbine engine disks. This invention provides a means for eliminating quench cracking while still permitting the development of excellent mechanical properties.

BACKGROUND ART

The heat treatment of metal parts often includes a quenching step in which the metal parts may be cooled from high temperatures to room temperature by immersion in a fluid such as water or oil. Depending upon the material involved, the size of the part and other factors, quench cracking is often encountered. Quench cracking arises as a result of the thermal stresses developed in the part during the cooling process and often occurs at areas of geometrical section change.

Quench cracking is a factor which limits the suitability of heat treatment processes with certain alloys. The modern tendency is to minimize excess material in turbine part preforms, thus even shallow cracking can ruin superalloy components since quench cracks cannot be completely removed by machining without producing an undersized part.

Quench cracks are observed to initiate at sites where prior oxidation has occurred—these sites are often grain boundaries. It might be thought that such cracking might be reduced or eliminated by performing the heat treatment in a vacuum or inert atmosphere. This is not feasible for two reasons, first the reactivity with oxygen of common superalloy constituents (Al, Ti, Hf, etc.) is so high that it is almost impossible to provide an atmosphere with sufficiently low oxygen level to avoid oxidation. The second reason is that inert atmosphere or vacuum furnaces both limit the speed with which the article can be quenched, thus compromising the heat treatment and resultant mechanical properties.

In the general field of heat treatments it is known to use coatings on the surfaces of parts to be heat treated for a variety of reasons. In the carburizing of steel for example, it is known to use localized copper plating to eliminate carburizing of selected surface portions. However, copper is an element known to adversely affect superalloys. In the heat treatment of steel it is also known to use glass based coatings on parts to reduce surface oxidation. Glass base coatings are generally fragile and impractical especially on massive parts.

DISCLOSURE OF INVENTION

This invention concerns a method for eliminating quench cracking in superalloy articles.

Historically there have been two techniques for producing large superalloy articles such as gas turbine engine disks. The first technique is casting and the second technique is forging. In the casting approach liquid metal is poured into a shaped mold and allowed to solidify to form the desired article. In the second technique, forging, a cast starting billet is extensively hot worked to form the desired configuration. The second technique produces articles of higher strength and uniformity than does the first technique and has supplanted the first technique for production of disks. Recently a third technique has been developed which involves powder metallurgy. In this technique, liquid metal is formed into powder particles which are then compacted into a shape which is near that of the desired end product. One method for achieving this compaction is that denoted as HIP or hot isostatic pressing. In the HIP process the powder is placed in a shaped container (usually a metal can) which is then evacuated and placed in a pressure vessel. The pressure vessel is filled with inert gas such as argon under high pressure and heated to an elevated temperature. At the elevated temperature the pressurized gas deforms both the container and the powder so as to bond the powder into a unitary article of theoretical density. The HIP-powder metallurgy approach is preferred for several reasons. It permits the production of articles which then require a minimum of final machining and also permits the production of articles which have a high degree of chemical homogeneity. A disadvantage encountered in the HIP process is that the powder material does not undergo significant deformation such as that encountered in the forging process. In the forging process the extensive amount of material deformation produces strengthening by the formation of dislocation networks. Such networks are not formed in the HIP process and instead the strength of the article is derived from the alloy composition and a suitable heat treatment which develops the required microstructure. The heat treatment of superalloys involves heating the alloy to a temperature near to or above the gamma prime solvus, quenching the alloy so as to minimize the growth of the gamma prime microstructural phase and reheating the quenched alloy to intermediate temperatures at which the gamma prime phase grows in a controllable fashion. A key part of the heat treatment process is the quench rate. If the quench rate is not sufficiently great, the gamma prime phase will grow substantially (in an undesirable morphology) during the quenching process and this will reduce the strength of the final article to less than the optimum. On the other hand if the quench process is too fast the article will crack.

It is an object of this invention to describe a method by which quench cracking may be largely eliminated from superalloy articles. The present invention involves the application of a thin layer of nickel by electroplating to the surface (or portion thereof) of the article prior to heat treatment. The nickel plate serves several functions in the heat treatment operation. First, it minimizes oxidation of the superalloy article. Such oxidation, which occurs preferentially at grain boundaries, acts as stress concentrators and during the quenching operation, quench cracks can occur at these intergranular oxidation sites. The nickel plate itself will oxidize to some extent during the heat treatment operation, however, oxidation of the substrate superalloy is precluded. A second benefit attributable to the nickel plate is that the nickel plate acts as an insulator and heat sink and thus shields the surface of the superalloy from the maximum thermal stresses. Furthermore, since the superalloy to be protected is based on nickel, the use of a nickel protective layer ensures that detrimental phases will not form at the interface between the nickel plate and the superalloy.

As previously indicated, in the HIP process, the powder is usually placed in a metal container prior to consolidation which can afford some protection from quench cracking. However there are processes which replace the metal container with a non-metallic one which results in heat treating without the benefit of a container. In such a process, the nickel plate layer of the present invention would have utility in protecting the entire outer surface of the consolidated article from quench cracking during heat treatment. Another application of the nickel plate of the present invention would be in cases where for one reason or another, a portion of the metal can was removed from the consolidated article. This might be performed in instances where a high quench rate was absolutely essential in one part of the superalloy article and not in other parts. In this case the consolidated article would have the can locally removed prior to heat treatment and it would be beneficial to apply a thin layer of nickel plate to the exposed area. A third application and one which is potentially quite significant, is that fully machined parts, found to have substandard properties, can be reheat-treated as a "repair" process and only if the surface can be protected.

BEST MODE FOR CARRYING OUT THE INVENTION

The invention involves the protection of the free surfaces of a nickel superalloy article from oxidation and subsequent quench cracking during heat treatment by the application of a thin layer of nickel plate. Nickel is the desirable material for plating. First, it is readily applied and is not particularly expensive. Second since it is the major constituent of most superalloys, it will not cause the formation of undesirable phases through diffusion and reaction with the superalloy. Third, it is at least moderately oxidation resistant. By the term nickel plate I mean layers of material applied by electroplating which are at least 60% nickel. I am aware that other ingredients such as chromium may be added to nickel plating baths so as to deposit nickel alloys. I consider these plating compositions to be within the scope of my invention. Chromium may have utility when combined with nickel in the process of the invention. Iron deposits also would provide benefits similar to nickel and are considered a part of this invention.

The details of the nickel plating process are known in the prior art and do not form a part of the invention. An extensive discussion of nickel plating is found in the book "Modern Electroplating" A. G. Gray ed. John Wiley & Sons Inc. NY, NY 1953. This discussion is incorporated herein by reference. The thickness of the nickel plate layer should be sufficient so that under the heat treatment conditions employed the maximum oxidation of the nickel plate layer will be substantially less than the thickness of the nickel plate so that (1) surface oxidation does not penetrate down to the superalloy substrate and (2) the thermal barrier allowed by the coating is maintained. Such a thickness depends to some extent on the exact heat treat conditions employed and may be readily determined experimentally for any particular situation, however I have found in my work that a thickness of about 0.015 inch is generally satisfactory.

Aside from composition and thickness, the essential required characteristic of the plated layer is that it be adherent and free from porosity. These requirements dictate that the disk surface be clean and free from contamination prior to plating, but this is a normal part of good plating practice.

It should be understood that the invention is not limited to the particular embodiments shown and described herein, but that various changes and modifications may be made without departing from the spirit and scope of this novel concept as defined by the following claim.

I claim:

1. In a method for heat treating nickel base superalloy articles including the steps of heating the article, to a temperature near or above the gamma prime solvus, quenching the article, and reheating the quenched article to an intermediate temperature, the improvement which comprises:

prior to heat treatment, electroplating the exposed surfaces with a thin adherent layer of a metal selected from the group consisting of nickel, alloys containing at leat 60% nickel along with additions of chromium and/or cobalt, and iron; whereby intergranular oxidation of the superalloy surfaces is prevented so that cracks do not initiate at sites where intergranular oxidation has occurred.

* * * * *